US007637373B2

(12) United States Patent
Stahl

(10) Patent No.: US 7,637,373 B2
(45) Date of Patent: Dec. 29, 2009

(54) STACKABLE CONTAINER

(75) Inventor: Edward L. Stahl, Tyler, TX (US)

(73) Assignee: Norseman Plastics, Ltd, Rexdale, Ontario (CA)

( * ) Notice: Subject to any disclaimer, the term of this patent is extended or adjusted under 35 U.S.C. 154(b) by 0 days.

(21) Appl. No.: 10/350,735

(22) Filed: Jan. 24, 2003

(65) Prior Publication Data

US 2004/0144680 A1 Jul. 29, 2004

(51) Int. Cl.
*B65D 21/04* (2006.01)

(52) U.S. Cl. ..... 206/512; 206/509

(58) Field of Classification Search ..... None
See application file for complete search history.

(56) References Cited

U.S. PATENT DOCUMENTS

| | | | | |
|---|---|---|---|---|
| 465,382 | A | 12/1891 | Marks | |
| 1,955,236 | A | 4/1934 | Jarvis | |
| 2,026,204 | A | 12/1935 | Andrews | 220/97 |
| 2,029,746 | A | 2/1936 | Tufts et al. | 220/97 |
| 2,061,414 | A | 11/1936 | Tufts et al. | 217/13 |
| 2,457,841 | A | 1/1949 | Smith et al. | |
| 2,457,842 | A | 1/1949 | Smith et al. | |
| 2,641,383 | A | 6/1953 | Coursey | 220/97 |
| 3,219,232 | A | 11/1965 | Wilson | |
| 3,375,953 | A | 4/1968 | Miller, Jr. | 220/97 |
| 3,379,339 | A | 4/1968 | Asenbauer | 200/97 |

(Continued)

FOREIGN PATENT DOCUMENTS

| | | |
|---|---|---|
| CA | 892971 | 2/1972 |
| CA | 1273881 | 9/1990 |
| CA | 2032012 | 6/1991 |
| CA | 2130973 | 3/1995 |
| CA | 2212239 | 8/1996 |

(Continued)

OTHER PUBLICATIONS

Mexican Foreign Associate letter dated May 9, 2006 with Mexican Office Action issued in Mexican Appln. No. 2011009 dated Apr. 12, 2006 (5 pages).

(Continued)

*Primary Examiner*—Stephen Castellano
(74) *Attorney, Agent, or Firm*—Ungaretti & Harris LLP

(57) ABSTRACT

A container configured to support a second identical container in a stacked relationship, comprising a base including a plurality of spaced apart members, the spaced apart members including at least one stacking member, and at least one container support member, wherein each of the at least one container support member is configured for engaging and supporting one of the at least one stacking member of the second identical container.

A container configured to support a second identical container in a stacked relationship, comprising a base including a plurality of spaced apart members, the spaced apart members including at least two stacking members, a first pair of opposing side walls projecting above the base and configured to support a second identical container, and a second pair of opposing end walls projecting above the base, at least one of the end walls including a pair of spaced apart container support means, wherein each of the container support means is configured for engaging and supporting at least one of the stacking members of the second identical container, such that the support of the stacking members of the second identical container by the container support means limits flexing of the base of the second identical container intermediate the pair of container support means of the second identical container.

6 Claims, 8 Drawing Sheets

U.S. PATENT DOCUMENTS

| | | | | |
|---|---|---|---|---|
| 3,387,740 | A | 6/1968 | Bockenstette | |
| 3,392,875 | A | 7/1968 | Bockenstette | |
| 3,420,402 | A | 1/1969 | Frater et al. | |
| 3,421,656 | A | 1/1969 | Asenbauer | 220/97 |
| 3,424,334 | A | 1/1969 | Goltz | |
| 3,425,594 | A | 2/1969 | Bridenstine | |
| 3,570,697 | A * | 3/1971 | Langston | 217/42 |
| 3,659,743 | A | 5/1972 | Box | 220/97 E |
| 3,675,815 | A | 7/1972 | Rehrig | |
| 3,752,352 | A | 8/1973 | Senecal | 220/19 |
| 3,780,905 | A | 12/1973 | Herolzer | 220/97 D |
| D236,168 | S * | 7/1975 | Johnson | D3/312 |
| 3,907,111 | A | 9/1975 | Levenhagen | |
| 3,934,724 | A | 1/1976 | Johnson | |
| 3,951,265 | A | 4/1976 | Carroll | 206/506 |
| 3,952,903 | A | 4/1976 | Sanders et al. | |
| 3,993,211 | A | 11/1976 | Astle | |
| 4,000,817 | A | 1/1977 | Sanders et al. | 206/505 |
| 4,093,070 | A | 6/1978 | Stahl | |
| 4,093,071 | A | 6/1978 | Stahl et al. | |
| 4,102,453 | A | 7/1978 | Carroll et al. | |
| 4,105,117 | A | 8/1978 | Atkin et al. | 206/501 |
| 4,106,623 | A | 8/1978 | Carroll et al. | 206/506 |
| 4,106,624 | A | 8/1978 | Thurman | |
| 4,106,625 | A | 8/1978 | Carroll et al. | |
| 4,109,791 | A | 8/1978 | Clipson et al. | 206/506 |
| 4,189,052 | A * | 2/1980 | Carroll et al. | 206/507 |
| 4,194,626 | A * | 3/1980 | Boller | 206/736 |
| 4,211,327 | A | 7/1980 | Stahl et al. | |
| 4,238,032 | A | 12/1980 | Thurman | |
| D258,050 | S | 1/1981 | Cornou | |
| 4,247,004 | A | 1/1981 | Bird | |
| 4,249,671 | A | 2/1981 | Crolli | |
| 4,316,154 | A | 2/1982 | Krause | |
| 4,320,837 | A | 3/1982 | Carroll et al. | |
| 4,383,611 | A | 5/1983 | Kreeger | |
| 4,391,369 | A | 7/1983 | Stahl et al. | 206/506 |
| 4,423,813 | A | 1/1984 | Kreeger et al. | |
| 4,426,001 | A | 1/1984 | Stahl et al. | |
| 4,440,302 | A | 4/1984 | Ehrman et al. | |
| 4,457,433 | A | 7/1984 | Wilson | |
| 4,466,541 | A | 8/1984 | Tabler et al. | |
| 4,520,928 | A | 6/1985 | Wilson | |
| 4,523,681 | A | 6/1985 | Kreeger | |
| 4,573,577 | A | 3/1986 | Miller | 206/506 |
| 4,577,759 | A | 3/1986 | Kreeger | |
| 4,600,103 | A | 7/1986 | Tabler | |
| 4,601,393 | A | 7/1986 | Veenman et al. | |
| RE32,223 | E | 8/1986 | Kreeger et al. | |
| 4,619,366 | A | 10/1986 | Kreeger | |
| 4,619,371 | A | 10/1986 | Rehrig | |
| 4,643,310 | A | 2/1987 | Deaton et al. | |
| 4,671,411 | A | 6/1987 | Rehrig et al. | |
| D292,634 | S | 11/1987 | Chabot | |
| 4,848,578 | A | 7/1989 | Schafer | |
| 4,905,833 | A | 3/1990 | Kreeger et al. | |
| 4,936,458 | A | 6/1990 | Tabler et al. | |
| 4,960,207 | A | 10/1990 | Tabler et al. | |
| 4,982,844 | A | 1/1991 | Madan et al. | |
| 5,035,326 | A | 7/1991 | Stahl | |
| D319,908 | S | 9/1991 | Stahl | |
| D320,298 | S | 9/1991 | Apps et al. | |
| 5,163,587 | A | 11/1992 | Apps et al. | |
| D343,042 | S | 1/1994 | Apps et al. | |
| D344,387 | S | 2/1994 | Holliday | |
| 5,287,966 | A | 2/1994 | Stahl | 206/509 |
| D348,138 | S | 6/1994 | Lang-Ree et al. | |
| D348,342 | S | 6/1994 | Lang-Ree et al. | |
| D348,343 | S | 6/1994 | Lang-Ree et al. | |
| D350,028 | S | 8/1994 | Apps | |
| D350,437 | S | 9/1994 | Apps et al. | |
| 5,344,021 | A | 9/1994 | Rose | |
| 5,344,022 | A | 9/1994 | Stahl | 206/507 |
| 5,372,257 | A | 12/1994 | Beauchamp et al. | |
| D354,167 | S | 1/1995 | Stahl | |
| 5,377,858 | A | 1/1995 | Morris, Sr. | |
| 5,415,293 | A | 5/1995 | Ackerman et al. | |
| 5,469,986 | A | 11/1995 | Jang | |
| 5,494,163 | A | 2/1996 | Apps | |
| D374,555 | S | 10/1996 | McMath | |
| 5,582,296 | A | 12/1996 | Beauchamp et al. | |
| 5,609,254 | A | 3/1997 | Loftus et al. | 206/506 |
| D379,718 | S | 6/1997 | Raghunathan | |
| D381,203 | S | 7/1997 | Ackermann et al. | |
| D384,975 | S | 10/1997 | Jackson | |
| 5,735,431 | A | 4/1998 | LeTrudet | |
| 5,752,602 | A | 5/1998 | Ackermann et al. | |
| 5,772,033 | A | 6/1998 | Loftus et al. | |
| D398,448 | S | 9/1998 | Zanni | |
| 5,816,406 | A | 10/1998 | Jupille | |
| D400,711 | S | 11/1998 | Hwang | |
| D401,066 | S | 11/1998 | Ackermann | |
| D401,412 | S | 11/1998 | LeTrudet | |
| 5,860,527 | A | 1/1999 | Frankenberg et al. | |
| 5,881,902 | A | 3/1999 | Ackermann | 206/509 |
| 5,896,987 | A | 4/1999 | Bettenhausen | |
| 5,896,992 | A | 4/1999 | McGrath | |
| 5,975,324 | A | 11/1999 | Schmitt | |
| 5,992,673 | A | 11/1999 | Hwang | |
| 6,015,056 | A | 1/2000 | Overholt et al. | |
| D420,219 | S | 2/2000 | Elvin-Jensen et al. | |
| 6,036,049 | A | 3/2000 | Hwang | |
| D423,217 | S | 4/2000 | Varfeldt | |
| D424,299 | S | 5/2000 | Varfeldt | |
| 6,062,388 | A | 5/2000 | Ohayon | |
| D429,565 | S | 8/2000 | Aiken | |
| 6,098,827 | A | 8/2000 | Overholt et al. | |
| 6,138,863 | A | 10/2000 | Aiken | |
| D436,729 | S | 1/2001 | Aiken | |
| D439,049 | S | 3/2001 | Koefelda | |
| 6,209,742 | B1 | 4/2001 | Overholt et al. | |
| 6,250,490 | B1 | 6/2001 | Loftus | |
| 6,260,706 | B1 | 7/2001 | Koefelda | |
| D446,017 | S | 8/2001 | Koefelda | |
| D446,392 | S | 8/2001 | Overholt et al. | |
| D446,939 | S | 8/2001 | Koefelda | |
| 6,273,259 | B1 | 8/2001 | Stahl | |
| 6,293,418 | B1 | 9/2001 | Ogden et al. | |
| 6,308,858 | B1 | 10/2001 | Koefelda et al. | |
| D452,614 | S | 1/2002 | Overholt | |
| 6,338,181 | B1 | 1/2002 | Hwang | |
| 6,386,388 | B1 | 5/2002 | Overholt | |
| 6,394,274 | B1 | 5/2002 | Cheeseman | |
| D458,753 | S | 6/2002 | Overholt et al. | |
| 6,398,054 | B1 | 6/2002 | Overholt et al. | |
| 6,405,888 | B1 | 6/2002 | Overholt et al. | |
| 6,409,041 | B1 | 6/2002 | Overholt et al. | |
| D460,619 | S | 7/2002 | Koefelda | |
| D463,667 | S | 10/2002 | Hwang | |
| 6,460,717 | B1 | 10/2002 | Smyers et al. | |
| D478,421 | S | 8/2003 | Overholt | |
| 6,601,724 | B1 | 8/2003 | Koefelda et al. | |
| 6,607,199 | B2 | 8/2003 | Gruber | |
| 6,631,822 | B1 | 10/2003 | Overholt | |
| 6,843,386 | B2 | 1/2005 | Raghunathan et al. | |
| 6,857,642 | B2 | 2/2005 | Gruber | |
| 6,863,180 | B2 | 3/2005 | Apps et al. | |
| 6,880,705 | B2 | 4/2005 | Otting et al. | |
| 6,886,710 | B2 | 5/2005 | Verna et al. | |
| 6,899,242 | B2 | 5/2005 | Overholt et al. | |
| 6,918,502 | B1 | 7/2005 | Overholt et al. | |
| 6,918,508 | B2 | 7/2005 | Hwang | |
| 6,994,216 | B2 | 2/2006 | Wong | |
| 7,017,766 | B2 | 3/2006 | Hsu et al. | |

| | | | |
|---|---|---|---|
| 7,044,319 | B2 | 5/2006 | Overholt et al. |
| 7,048,134 | B1 | 5/2006 | Hagan |
| 7,048,135 | B2 | 5/2006 | Smyers et al. |
| 7,059,489 | B2 | 6/2006 | Apps et al. |
| 7,063,210 | B2 | 6/2006 | Smyers et al. |
| 7,086,555 | B2 | 8/2006 | Overholt et al. |
| 7,100,786 | B2 | 9/2006 | Smyers |
| 7,104,414 | B2 | 9/2006 | Apps et al. |
| 7,104,553 | B2 | 9/2006 | Gruber |
| 7,128,231 | B2 | 10/2006 | Overholt |
| 7,195,127 | B2 | 3/2007 | Hsu et al. |
| 7,264,122 | B2 | 9/2007 | Koefelda et al. |
| 7,320,405 | B2 | 1/2008 | Stahl |
| 2002/0013132 | A1 | 1/2002 | Newstead |
| 2002/0056717 | A1 | 5/2002 | Hwang |
| 2002/0148842 | A1 | 10/2002 | Overholt et al. |
| 2002/0153682 | A1 | 10/2002 | Gruber |
| 2002/0158067 | A1 | 10/2002 | Overholt et al. |
| 2003/0024845 | A1 | 2/2003 | Smyers et al. |
| 2003/0042255 | A1 | 3/2003 | Smyers et al. |
| 2003/0116564 | A1 | 6/2003 | Overholt et al. |
| 2003/0132228 | A1 | 7/2003 | Apps et al. |
| 2003/0155275 | A1 | 8/2003 | Apps et al. |
| 2003/0183549 | A1 | 10/2003 | Verna et al. |
| 2003/0222081 | A1 | 12/2003 | Apps et al. |
| 2003/0230510 | A1 | 12/2003 | Aiken et al. |
| 2004/0020821 | A1 | 2/2004 | Koefelda et al. |
| 2004/0050742 | A1 | 3/2004 | Gruber |
| 2004/0060844 | A1 | 4/2004 | Stahl |
| 2004/0069780 | A1 | 4/2004 | Apps et al. |
| 2004/0074801 | A1 | 4/2004 | Ritter et al. |
| 2004/0099662 | A1 | 5/2004 | Overholt |
| 2004/0104231 | A1 | 6/2004 | Hassell et al. |
| 2004/0144680 | A1 | 7/2004 | Stahl |
| 2004/0155048 | A1 | 8/2004 | Aiken |
| 2004/0178197 | A1 | 9/2004 | Hsu et al. |
| 2004/0182858 | A1 | 9/2004 | Smyers |
| 2004/0195139 | A1 | 10/2004 | Wong |
| 2004/0226945 | A1 | 11/2004 | Hsu et al. |
| 2005/0140107 | A1 | 6/2005 | Gruber |
| 2005/0183980 | A1 | 8/2005 | Fernandez et al. |
| 2006/0011627 | A1 | 1/2006 | Overholt et al. |
| 2006/0070906 | A1 | 4/2006 | Verna |
| 2006/0180491 | A1 | 8/2006 | Zephir et al. |
| 2006/0186123 | A1 | 8/2006 | Baltz et al. |
| 2006/0196800 | A1 | 9/2006 | Baltz |
| 2006/0231555 | A1 | 10/2006 | Smyers et al. |
| 2006/0237341 | A1 | 10/2006 | McDade |
| 2007/0056874 | A1 | 3/2007 | Apps et al. |

FOREIGN PATENT DOCUMENTS

| | | | |
|---|---|---|---|
| CA | 2484830 | | 8/1996 |
| CA | 2313137 | | 7/1997 |
| CA | 2296895 | | 7/2000 |
| CA | 2 389 010 | | 10/2000 |
| CA | 2129617 | | 10/2000 |
| CA | 2326118 | | 5/2001 |
| CA | 2387491 | | 5/2001 |
| CA | 2389010 | | 5/2001 |
| CA | 2392265 | | 6/2001 |
| CA | 2395367 | | 7/2001 |
| CA | 2397522 | | 8/2001 |
| CA | 2406099 | | 10/2001 |
| CA | 2408247 | | 11/2001 |
| CA | 2384941 | | 1/2002 |
| CA | 2421595 | | 3/2002 |
| CA | 2426949 | | 5/2002 |
| CA | 2367649 | | 7/2002 |
| CA | 2442723 | | 10/2002 |
| CA | 2455355 | | 2/2003 |
| CA | 2458773 | | 3/2003 |
| CA | 2472360 | | 7/2003 |
| CA | 2475531 | | 9/2003 |
| CA | 2485544 | | 12/2003 |
| CA | 2448920 | | 7/2004 |
| CA | 2431444 | | 12/2004 |
| EP | 0 370 771 | A2 | 5/1990 |
| FR | 1 131 652 | | 9/1955 |
| FR | 2678585 | | 1/1993 |
| GB | 2 059 920 | | 4/1981 |
| GB | 2 067 167 | A | 7/1981 |
| GB | 2129401 | | 5/1984 |
| GB | 2137167 | | 10/1984 |
| GB | 2141778 | | 1/1985 |
| GB | 2171980 | | 9/1986 |
| GB | 2180821 | | 4/1987 |
| JP | 9-239739 | | 9/1997 |
| TW | 338405 | | 8/1998 |
| TW | 372539 | | 10/1999 |
| WO | 00/27716 | | 5/2000 |
| WO | 00/66440 | | 11/2000 |
| WO | 01/85558 | | 11/2001 |

OTHER PUBLICATIONS

Office Action dated May 27, 2004, issued in EP Application No. 01 931 263.6-2308 (2 pages).
Office Action dated Jun. 2, 2005, issued in EP Application No. 01 931 263.6-2308 (3 pages).
Office Action dated Jan. 16, 2006, issued in Canadian Application No. 2,448,920 (2 pages).
Office Action dated Nov. 24, 2005, issued in Canadian Application No. 2,408,247 (3 pages).
IPER; PCT/CA01/00640; Sep. 10, 2002; 11 pages.
Canadian Official Action; CA 2,367,649; Feb. 20, 2006; 2 pages.
Canadian Official Action; CA 2,431,444; Dec. 12, 2005; 2 pages.
"Wavin Crate, allegedly circa 1998"; 3 sheets-photos.

* cited by examiner

STACKABLE CONTAINER

FIELD OF INVENTION

The present invention relates to containers and, more particularly, to containers of the stackable tray type for bakery goods and the like.

BACKGROUND OF THE INVENTION

Containers for storing and transporting bakery goods and the like are typically made of a one-piece construction of a suitable plastic material and are configured for stacking of one upon another. In this respect, such containers are typically configured to permit support and registry of the first container with the second container when the first container is vertically mounted upon the second container. During the stacking of such containers, the base of the upper container is susceptible to flexing or buckling upon the application of a load. There is, therefore, a need for containers designed for stacking and which are less susceptible to the above-described flexing phenomenon.

SUMMARY OF THE INVENTION

The present invention provides a container configured to support a second identical container in a stacked relationship, comprising a base including a plurality of spaced apart members, the spaced apart members including at least one stacking member, and at least one container support member, wherein each of the at least one container support member is configured for engaging and supporting one of the at least one stacking member of the second identical container.

In one aspect the at least one container support member is aligned with one of the at least one stacking member of the second identical container such that each of the at least one container support member is disposed for engaging and supporting the one of the at least one stacking member of the second identical container. The at least stacking member can be a stacking rib. The at least container support member can be a support rib.

A container configured to support a second identical container in a stacked relationship, comprising a base including a plurality of spaced apart members, the spaced apart members including at least two stacking members, and a pair of spaced apart container support means, wherein each of the container support means is configured for engaging and supporting at least one of the stacking members of the second identical container, such that the support of the stacking members of the second identical container, by the support means, limits flexing of the base of the second identical container intermediate the pair of support means of the second identical container.

In one aspect each of the container support means is aligned with a corresponding at least one of the stacking members of a second identical container such that each of the container support means is disposed for engaging and supporting the corresponding at least one of the stacking members of the second identical container.

In another aspect, each of the support means is a support rib.

In yet another aspect, each of the at least two stacking members is a stacking rib.

The present invention also provides a container configured to support a second identical container in a stacked relationship, comprising a base including a plurality of spaced apart members, the spaced apart members including at least two stacking members, and lateral support means configured to provide lateral support to objects when such objects are supported on the base, the lateral support means including a pair of spaced apart container support means, wherein each of the container support means is configured for engaging and supporting at least one of the stacking members of the second identical container, such that the support of the stacking members of the second identical container by the container support means limits flexing of the base of the second identical container intermediate the pair of container support means of the second identical container.

In one aspect, each of the container support means is aligned with a corresponding at least one of the stacking members of the second identical container such that each of the container support means is disposed for engaging and supporting the corresponding at least one of the stacking members of the second identical container.

In another aspect, each of the container support means can be disposed on the external surface of the lateral support means.

In yet another aspect, each of the container support means can include a plurality of ribs, wherein each of the plurality of ribs is configured for engaging and supporting one of the stacking members of the second identical container.

In a further aspect, each of the plurality of ribs can be align with a corresponding one of the stacking members of the second identical container such that each of the container support means is disposed for engaging and supporting the corresponding one of the stacking members of the second identical container.

In another aspect, each of the stacking members is a stacking rib.

The present invention also provides a container configured to support a second identical container in a stacked relationship, comprising a base including a plurality of spaced apart members, the spaced apart members including at least two stacking members, a first pair of opposing side walls projecting above the base and configured to support a second identical container, and a second pair of opposing end walls projecting above the base, at least one of the end walls including a pair of spaced apart container support means, wherein each of the container support means is configured for engaging and supporting at least one of the stacking members of the second identical container, such that the support of the stacking members of the second identical container by the container support means limits flexing of the base of the second identical container intermediate the pair of container support means of the second identical container.

In one aspect, each of the container support means is aligned with a corresponding at least one of the stacking members of the second identical container such that each of the container support means is disposed for engaging and supporting the corresponding at least one of the stacking members of the second identical container.

In another aspect, each of the stacking members is a stacking rib.

In yet another aspect, each of the container support means is a support rib.

In yet another aspect, each of the container support means is disposed on the external surface of the at least one end wall.

In another aspect, each of the plurality of ribs is aligned with a corresponding one of the stacking means of the second identical container such that each of the container support means is disposed for engaging and supporting the corresponding one of the stacking members of the second identical container.

In another aspect, the end wall having the container support means defines a merchandiser window intermediate the first and second container support means. The end wall having the container support means includes a first end and a second end, wherein one of the pair of container support means is disposed proximate one of the first and second ends, and the second of the pair of container support means is disposed proximate the other of the first and second ends.

DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION

Figure 1:
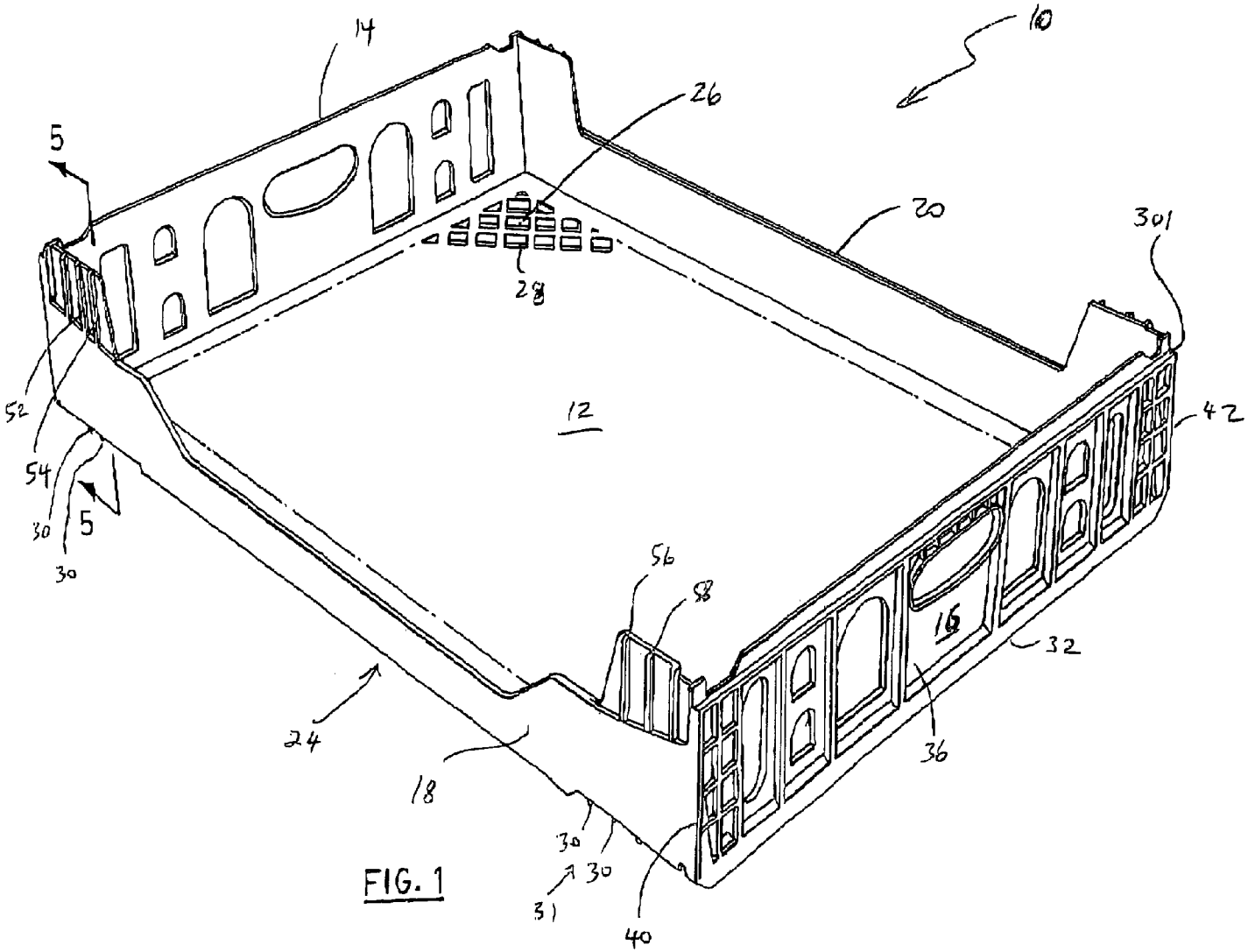
FIG. 1 is a perspective view of a first embodiment the container of the present invention.
Figure 2:
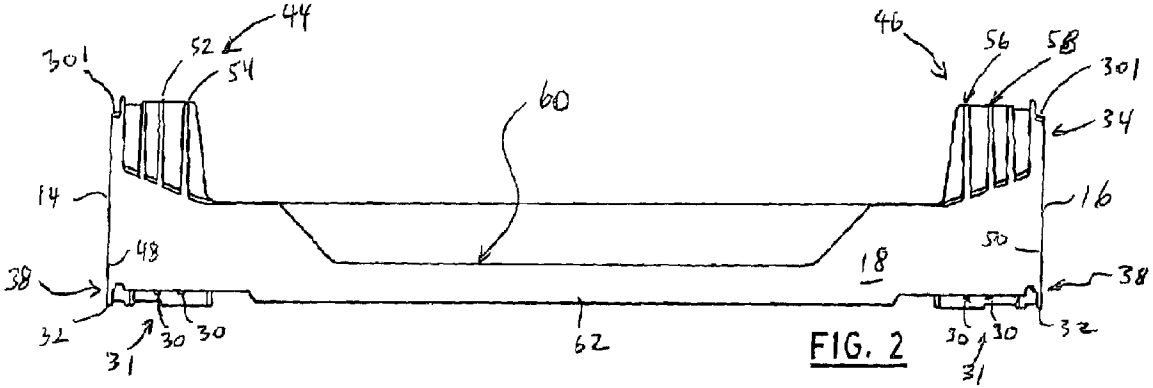
FIG. 2 is a front end view of the container illustrated in FIG. 1.
Figure 3:
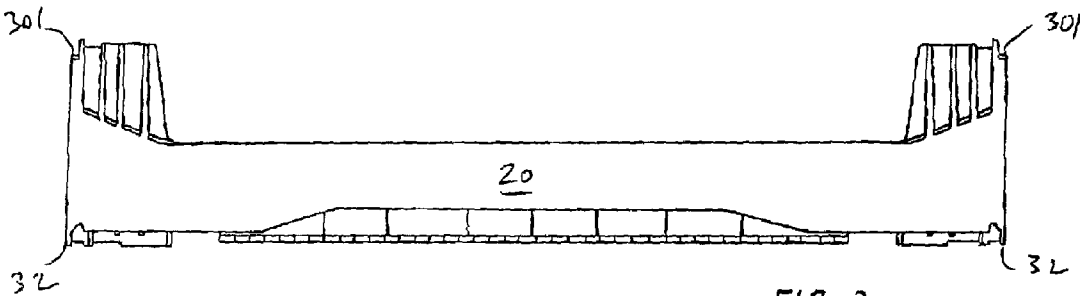
FIG. 3 is a rear end view of the container illustrated in FIG. 1.
Figure 4:
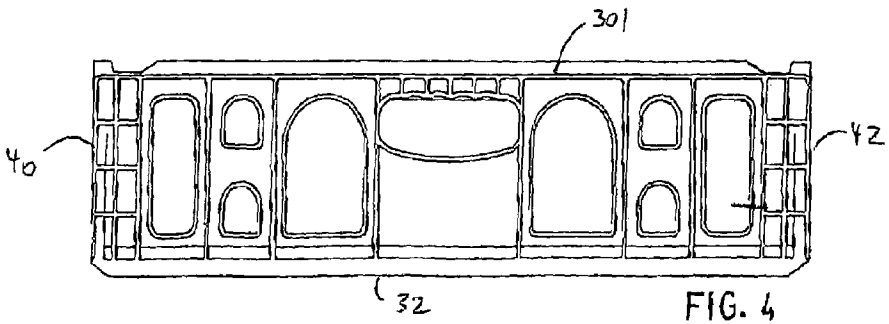
FIG. 4 is a side elevation view of a first side of the container illustrated in FIG. 1, the second opposing side being a mirror image of the first side.

Referring to FIG. 1, the present invention provides a container 10 including a base 12, a first pair of opposed sidewalls 14, 16 and a second pair of opposed endwalls 18, 20. Each of the endwalls 18, 20 is joined to the sidewalls 14, 16 to define a continuous sidewall. The container 10 is molded of integral one-piece construction of a suitable plastic material such as, for example, polyethylene or polypropylene. The container 10 is configured to facilitate mounting thereon of a second identical container 110 in the manner illustrated in FIGS. 6, 7, and 9 (a container mounted on another container in this manner is hereinafter referred to as being in a "stacked orientation"), to thereby define upper and lower containers 110, 10. Note that the second container 110 is identical in every respect to the first container 10, and that like reference numerals have been provided for like parts. It is understood that more than two containers 10 of the present invention may be mounted upon one another in the stacked orientation.

The base 12 includes an upper surface 22 and a lower surface 24. The upper surface 22 supports objects placed thereon. The lower surface 24 supports the container on a reaction surface, such as a floor. The base 12 includes a plurality of openings 26 extending from the upper surface 22 to the lower surface 24 and thereby connecting the upper surface 22 to the lower surface 24. The openings 26 are defined by a plurality of interconnected ribs 28. By including the openings 26 in the base 12, the container 10 requires less material, thereby rendering the container 10 lighter and reducing material costs.

Figure 5:
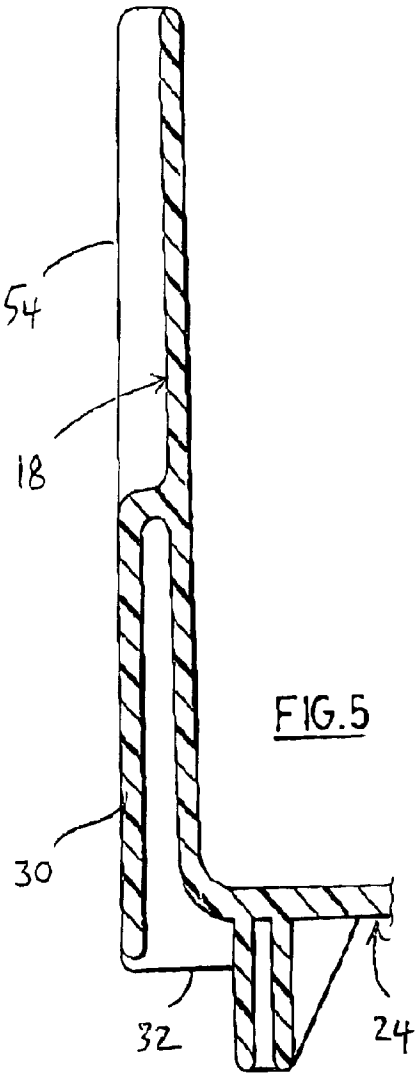
FIG. 5 is a cross sectional view taken at lines 5-5 of FIG. 1.
Figure 8:
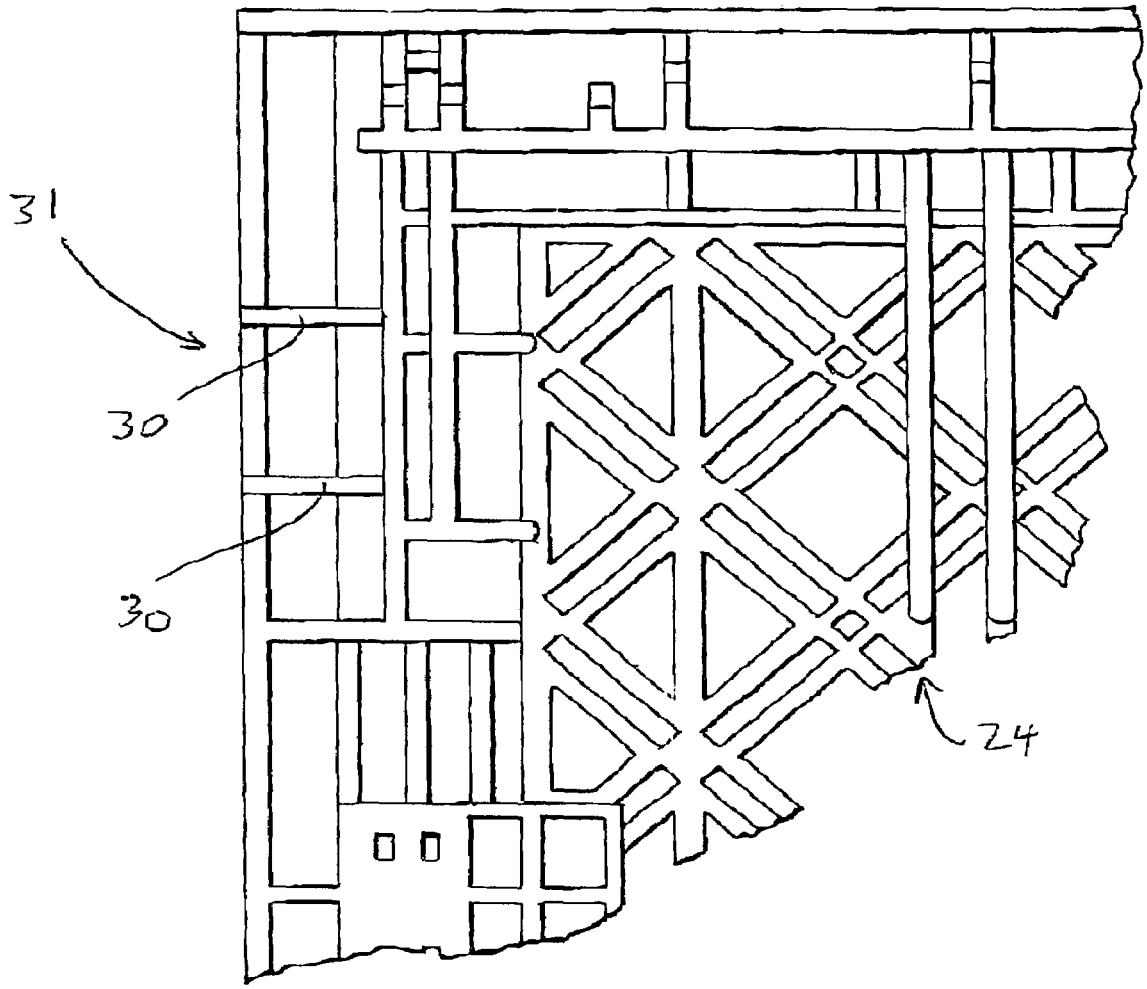
FIG. 8 is a fragmentary bottom plan view of the container in FIG. 1, illustrating the base of the container.

Referring to FIGS. 1, 5 and 8, the lower surface 24 of the base 12 includes a plurality of spaced apart stacking ribs 30 defining stacking members 31 for engagement to and support, while in the stacked orientation, by a lower container 10.

The sidewalls 14, 16 and endwalls 18, 20 extend from and project above the base 12. The sidewalls 14, 16 and endwalls 18, 20 function as lateral support means configured to provide lateral support to objects placed on the upper surface of the base 12.

Each of the sidewalls 14, 16 includes a flange or stacking shelf 301, and a runner 32. The stacking shelf 301 is configured to engage and support a runner 30 of a corresponding sidewall 32 of a second identical container 110, when the second container 110 is mounted on the first container 10 in the stacked orientation. In this respect, the stacking shelf 301 is provided at an upper portion 34 of an exterior wall 36 of each sidewall, and the runner 32 is provided at a lower portion 38 of the exterior wall 36, and the runner is aligned with the stacking shelf 301. Preferably, the stacking shelf 301 and the runner of each sidewall 14, 16 extend from a first end 40 to the second end 42 of each sidewall to improve stability of the mounting of one container 10 on the other.

An external surface of at least one of the endwalls 18, 20 (for example, endwall 18) includes a pair of spaced apart first and second container support means 44, 46. Each of the container support means 44, 46 is configured to engage and support one or more of the stacking members 31 provided on the base 12 of a second identical container 110 when the second container 110 is mounted on the first container 10 in the stacked orientation. By engaging and supporting the stacking members 31 on the upper container 110 with the container supporting means 44, 46 on the lower container 10, flexing of the base 12 of the upper container 110 intermediate the container support means 44, 46 is limited. The first container support means 44 is disposed proximate one end 48 of the endwall 18, and the second container support means 46 is disposed proximate a second opposite end 50 of the endwall 18. In the embodiment illustrated in FIG. 1, each of the container support means 44, 46 consists of two support ribs 52, 54 and 56, 58 disposed on the external surface 42 of the endwall 18 and, more particularly, extending laterally outwardly from the endwall 18. The support ribs 52, 54 and 56, 58 are aligned with the stacking ribs 30 such that the support ribs 52, 54 and 56, 58 are configured to engage and support the stacking ribs 30 of a second identical container 110 mounted on the first container 10 in the stacked orientation. It is understood that the container support means 44, 46 can comprise of any number of ribs and still fall within the scope of the invention. The container support means 44, 46 take the form of spaced-apart ribs 52, 54 and 56, 58 so as to reduce material requirements while still providing an adequate surface for support of the upper container 110 to limit buckling or flexing of the base 12 of the upper container 110 when the upper container 110 is subjected to loading.

In the embodiment of the container 10 illustrated in FIGS. 1-9, the endwall 18 differs from the endwall 20 in that the endwall 18 defines a merchandiser window 60. In this respect, the endwall 18 includes a section 62 which is of a lower vertical height than the endwall 20 and is configured to allow products to be loaded onto and off the base 12 from the endwall 20 when one container 10 is mounted on another in the stacked orientation. Because the endwall 18 is of a lower vertical height than the endwall 20, the endwall 18 contributes less rigidity to the base 12 than the endwall 20. As a result, the region of the base 12 proximate to the endwall 18 is stiffer (ie. less resilient) than the region of the base 12 proximate to the endwall 18, and is, therefore, less susceptible to deformation when in the stacked orientation upon the application of a load to the base 12. To compensate for this lower degree of rigidity, the endwall 18 includes the container support means 44, 46 to distribute the load acting on the container 10 from a second identical container 110 when mounted in the stacked orientation. Of course, provision of the co-operative container support means 44, 46 and stacking members 30 is not restricted to the endwall 18, and co-operative container support means 44, 46 and stacking members 30 could also be provided on the endwall 20 to increase stiffness of the base 12 proximate the endwall 20 during stacking of identical containers.

Figure 10:
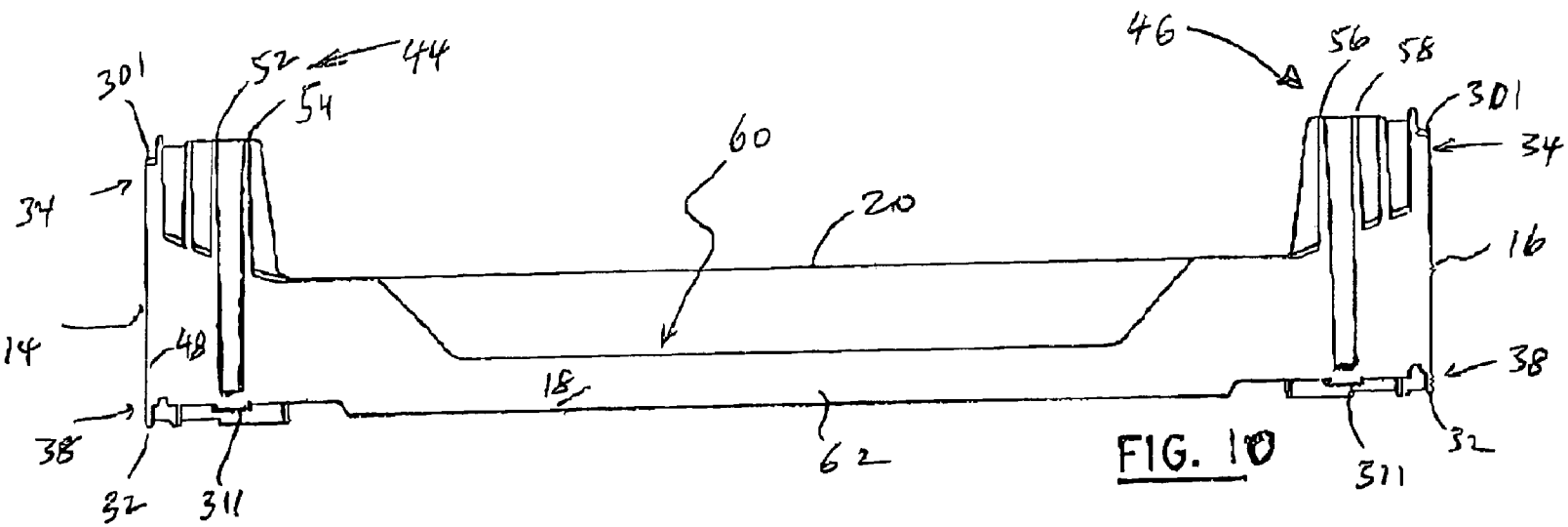
FIG. 10 is a front end view of a first side of a second embodiment of the container of the present invention.

FIG. 10 illustrates a container 210, which is a second embodiment of the present invention. Container 210 is similar to container 10, with the exception that each of the stacking members 31 is defined by a stacking web 311.

Figure 6:
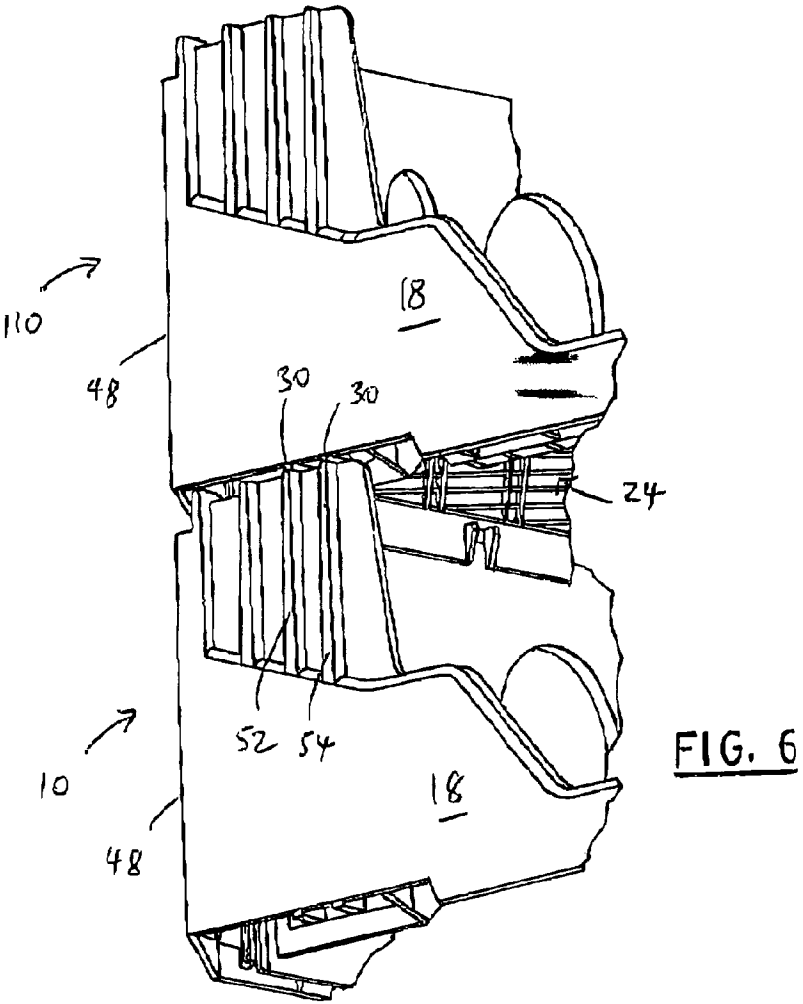
FIG. 6 is a fragmentary top perspective view illustrating the container illustrated in FIG. 1 in a stacked relationship with a second identical container.
Figure 7:
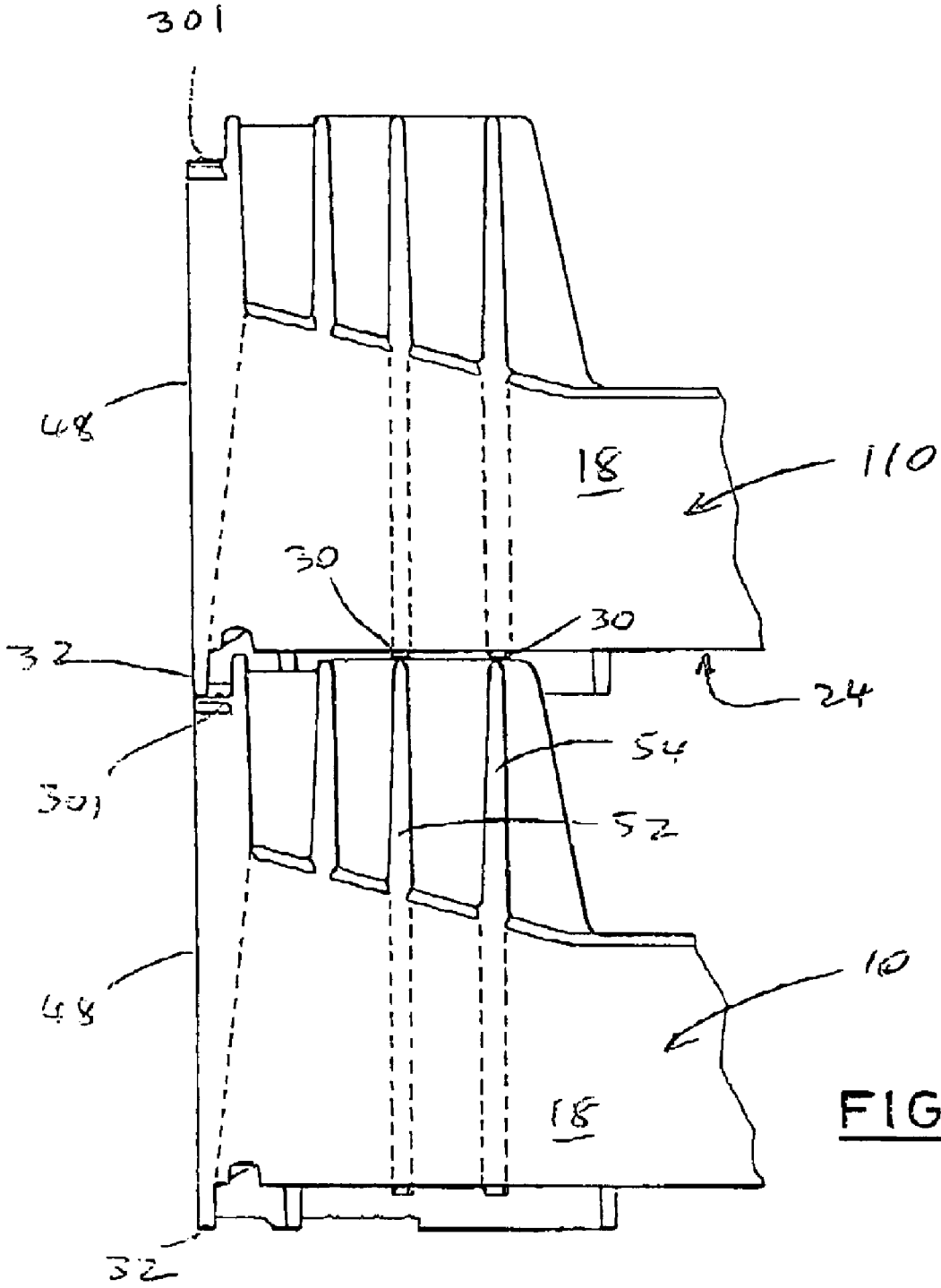
FIG. 7 is a fragmentary side elevation view illustrating containers of the present invention in the stacked relationship illustrated in FIG. 6.
Figure 9:
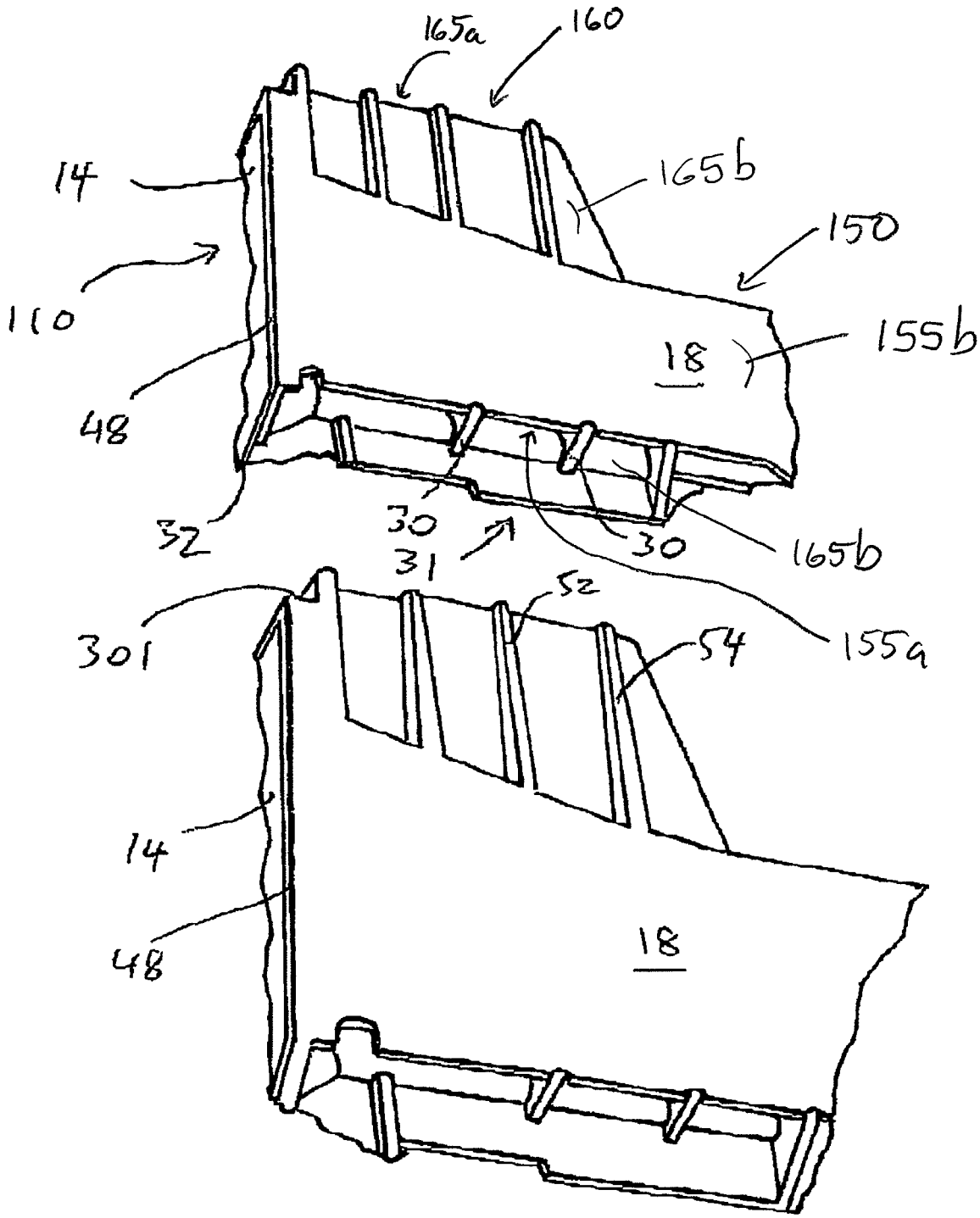
FIG. 9 is a fragmentary bottom perspective view of two containers, each identical to the container in FIG. 1, with the upper container in preparation for position in a stacked orientation with the lower container.

The operation of mounting one container 110 on another container 10, such that the containers 10, 110 become stacked as upper and lower containers 110, 10, will now be described with reference to FIGS. 6, 7 and 9. As FIG. 9 illustrates, endwall 18 includes an endwall inner wall portion 160 and an endwall outer wall portion 150. Endwall inner wall portion 160 further includes an inner surface 165*a* and an outer surface 165*b*. Endwall outer wall portion 150 further includes an inner surface 155*a*, and an outer surface 155*b*. As can further be seen in FIG. 9, stacking member 31, which comprises stacking ribs 30, extends from the outer surface 165*b* of endwall inner wall portion 160, to inner surface 155*a* of endwall outer wall portion 150. The upper container 110 is first positioned for stacking engagement with the lower container 10 by effecting alignment of the stacking ribs 30 of the upper container with the support ribs 52, 54 and 56, 58 of the lower container 10 (see FIG. 9). The container 110 is then lowered such that the runners 32 on each of the sidewalls 14, 16 engage and become supported by the corresponding shelves 301 on the lower container 10, and the stacking ribs 30 engage and become supported by the corresponding support means 44, 46 of the lower container 10. This stacked orientation of the upper container 110 on the lower container 10 is illustrated in FIGS. 6 and 7.

It is understood that, in the stacked orientation, the stacking ribs 30 of the upper container 110 do not necessarily have to be engaged and supported by the support ribs 52, 54 and 56, 58 of the lower container 110 under all conditions (for example, such engagement and support may not be present when the upper container 110 is empty). Rather, the support ribs 52, 54 and 56, 58 of the lower container 10 can be spaced-apart from the corresponding stacking ribs 30 of the upper container 110 while the upper container 110 is empty, but can be configured to engage and support the stacking ribs 30 of the upper container 110 once the base of the upper container 110 flexes upon application of a load, such flexing causing the stacking ribs 30 of the upper container 110 to become lowered into engagement with the support ribs 52, 54 and 56, 58 of the lower container 10.

Figure 11:
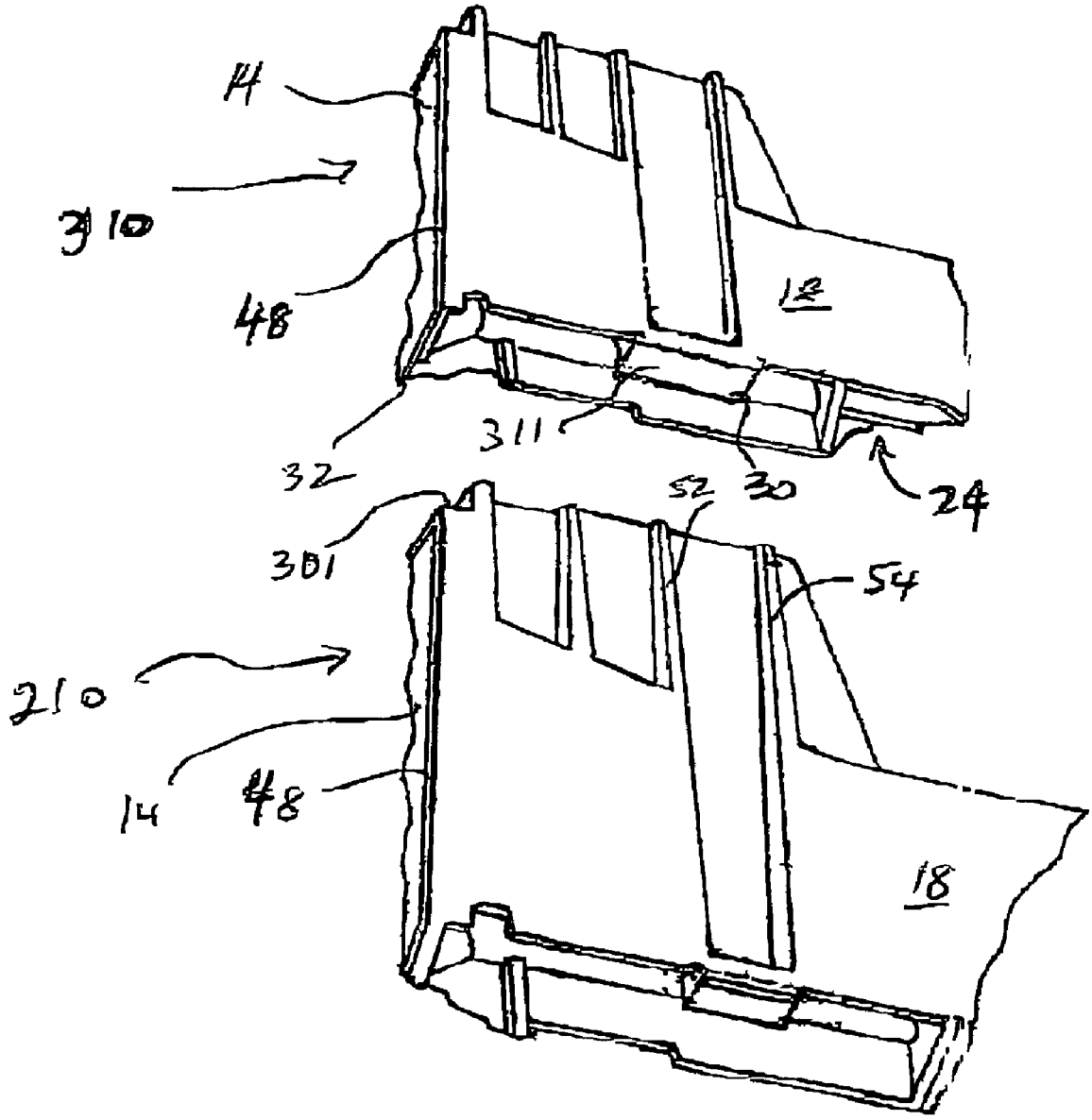
FIG. 11 is a fragmentary top perspective view illustrating the container illustrated in FIG. 10 in a stacked relationship with a second identical container.

FIG. 11 illustrates identical containers 210, 310 of the second embodiment of the present invention in position for stacking engagement with each other. In this respect, the support ribs 52, 54 and 56, 58 of the container 210 are aligned with the corresponding stacking webs 311 of the base 24 of the container 310. To effect stacking engagement, the container 310 is lowered such that the runners 32 on each of the sidewalls 14, 16 engage and become supported on the corresponding shelves 31 on the lower container 210, and each of the stacking webs 311 engages and becomes supported by the corresponding ribs 52, 54 and 56, 58 of the container 210.

Although the disclosure describes and illustrates preferred embodiments of the invention, it is to be understood that the invention is not limited to these particular embodiments. Many variations and modifications will now occur to those skilled in the art. For definition of the invention, reference is to be made to the appended claims.

The invention claimed is:

1. A container configured to support a second substantially identical container in a stacked relationship, comprising:

a base including at least one stacking member;

a side-wall extending from and projecting upwardly from the base, the side-wall comprising an outer face and at least one container stacking shelf extending laterally and outwardly from the outer face of the side-wall, and at least one stacking runner, the at least one container stacking shelf configured to engage and support a corresponding at least one stacking runner of the second identical container; and an end-wall, adjacent the side-wall, the end-wall extending from and projecting upwardly from the base, the end-wall comprising an end-wall outer wall portion and an end-wall inner wall portion and at least one container support means, wherein, the end-wall outer wall portion includes an inner surface and an outer surface, and the end-wall inner wall portion includes an inner surface and an outer surface, the at least one container support means comprising at least one stacking rib extending substantially perpendicular outward from the outer surface of the end-wall inner wall portion at an upper portion of the end-wall inner wall portion, to form a support shoulder thereon, and wherein the at least one stacking rib joins the end-wall outer wall portion at a position lower than the upper portion of the end-wall inner wall portion, wherein the at least one container support means is configured to engage and support a corresponding stacking member of the second substantially identical container, and further wherein the stacking member extends substantially perpendicularly from the outer surface of the end-wall inner wall portion at the base, to the inner surface of the end-wall outer wall portion at the base.

2. The container as claimed in claim 1, wherein each of the at least one container support means is aligned with the corresponding at least one stacking member of the second substantially identical container, such that each of the at least one container support means is configured to engage and support the corresponding at least one stacking member of the second substantially identical container.

3. The container as claimed in claim 1, wherein each of the at least one stacking member comprises:

two stacking ribs substantially parallel to each other and substantially perpendicular to the end-wall, and wherein a bottommost portion of each of the at least one stacking member is substantially planar with a bottommost potion of the base.

4. The container as claimed in claim 1, wherein each of the at least one container support means comprises at least two ribs.

5. The container as claimed in claim 1, wherein the end-wall comprises:

a first end-wall inner wall portion proximate to a first end of the end-wall; and a second end-wall inner wall portion proximate to a second opposite end of the end-wall, and wherein the at least one container support means includes (i) at least one container support means extending laterally and outwardly from the first end-wall inner wall portion, and (ii) at least one container support means extending laterally and outwardly from the second end-wall inner wall portion.

6. The container as claimed in claim 5, wherein the first end-wall inner wall portion extends downwardly from a first upper edge portion of the end-wall, and the second end-wall inner wall portion extends downwardly from a second upper edge portion of the end-wall, and wherein the end-wall further comprises a merchandiser window upper edge portion defining a merchandiser window disposed between the first upper edge portion and the second upper edge portion, such that the merchandiser window upper edge portion has a lower vertical height than each of the first upper edge portion and the second upper edge portion.

* * * * *